United States Patent [19]

Aoki et al.

[11] Patent Number: 4,494,856

[45] Date of Patent: Jan. 22, 1985

[54] ELECTROPHOTOGRAPHIC METHOD AND APPARATUS FOR PROVIDING ACCURATE HALF-TONE IMAGES

[75] Inventors: Takao Aoki, Abiko; Takahiro Inoue; Masahiro Goto, both of Yokohama; Kenji Takeda, Kawasaki, all of Japan

[73] Assignee: Canon Kabushiki Kaisha, Tokyo, Japan

[21] Appl. No.: 410,061

[22] Filed: Aug. 20, 1982

[51] Int. Cl.[3] ..... G03G 15/22

[52] U.S. Cl. ..... 355/3 R; 355/3 CH; 430/54; 430/55

[58] Field of Search ..... 355/3 CH, 3 R, 14 CH; 361/229; 250/324, 325, 326; 430/54, 55, 902

[56] References Cited

U.S. PATENT DOCUMENTS

| | | | |
|---|---|---|---|
| 3,666,363 | 5/1972 | Tanaka et al. | 355/10 X |
| 3,797,927 | 3/1974 | Takahashi et al. | 355/3 R |
| 4,311,778 | 1/1982 | Kadowaki et al. | 430/54 |

FOREIGN PATENT DOCUMENTS

| | | | |
|---|---|---|---|
| 0149035 | 12/1978 | Japan | 355/3 R |

*Primary Examiner*—A. T. Grimley
*Assistant Examiner*—J. Pendegrass
*Attorney, Agent, or Firm*—Fitzpatrick, Cella, Harper & Scinto

[57] ABSTRACT

An electrophotographic method and apparatus is disclosed which is able to faithfully reproduce the half-tone portion of an original image on a photosensitive medium having an electroconductive layer, a photoconductive layer and an insulating surface layer. The present invention is directed particularly to improvements in the secondary charging step in the above method. According to the invention, the process of secondary charge includes the steps of subjecting the photosensitive medium to the action of corona discharge having the component of opposite polarity to that of the primary charge with simultaneous light image exposure, exposing the photosensitive medium surface to a light image while reducing or stopping the action of corona discharge and exposing the photosensitive medium surface to a light image while controlling the amount of corona discharge.

14 Claims, 15 Drawing Figures

ELECTROPHOTOGRAPHIC METHOD AND APPARATUS FOR PROVIDING ACCURATE HALF-TONE IMAGES

BACKGROUND OF THE INVENTION

1. Field of the Invention

The present invention relates to an electrophotographic method and more particularly to an electrophotographic method and apparatus for image formation with high reproducibility of gradation.

2. Description of the Prior Art

In our prior application, Japanese patent application laid open No. 14,237/1979 (U.S. Pat. No. 4,311,778) an electrophotographic method has been disclosed which enables to attain good reproduction of gradation. The range of reproducibility of original brightness (the range of reproducibility of original density) hitherto attainable by conventional electrophotographic methods was about 0.7. In contrast, according to the method proposed by the above-referred prior application, the reproducibility of original brightness can be improved to the range of 1.0 to 1.3.

However, the method has the following problem:

It includes the step of repeating the exposure of light image while gradually increasing the intensity of exposure light exposure by exposure. Because of the repeating image-wise exposure, the method requires a great deal of exposure as compared with the conventional exposure step. Therefore, to carry out the method there arises a difficulty in controlling the exposure. On the other hand, it renders very complicate the apparatus for carrying out the method.

SUMMARY OF THE INVENTION

It is an object of the invention to obtain reproduced images abundant in gradation.

It is another object of the invention to faithfully reproduce the half-tone of original.

It is a further object of the invention to obtain color images reproduced with high degree of quality.

The present invention attaining the above objects is directed to the process for forming electrostatic latent images on a photosensitive medium comprising an electroconductive layer, a photo conductive layer and an insulating surface layer.

The electrostatic latent image forming process according to the invention includes the steps of:

(a) uniformly charging the insulating surface layer of the photosensitive medium with a selected polarity;

(b) subjecting the photosensitive medium to corona discharge having a component of opposite polarity to the polarity for uniform charging in above step (a) while exposing the photosensitive medium to light image at the same time;

(c) exposing the photosensitive medium to light image thereby increasing the surface potential on the half-tone area of the light image of the photosensitive medium;

(d) subjecting the photosensitive medium to corona discharge having a component of opposite polarity to the polarity in above step (a) under the effect of light image exposure to discharge a part of the surface potential of the half-tone area once increased at the step (c) so as to set a determined potential on the photosensitive medium and (e) exposing the photosensitive medium to uniform light.

Other and further objects, features and advantages of the invention will appear more fully from the following detailed description taken in connection with the accompanying drawings.

DETAILED DESCRIPTION OF PREFERRED EMBODIMENT

Figure 1:
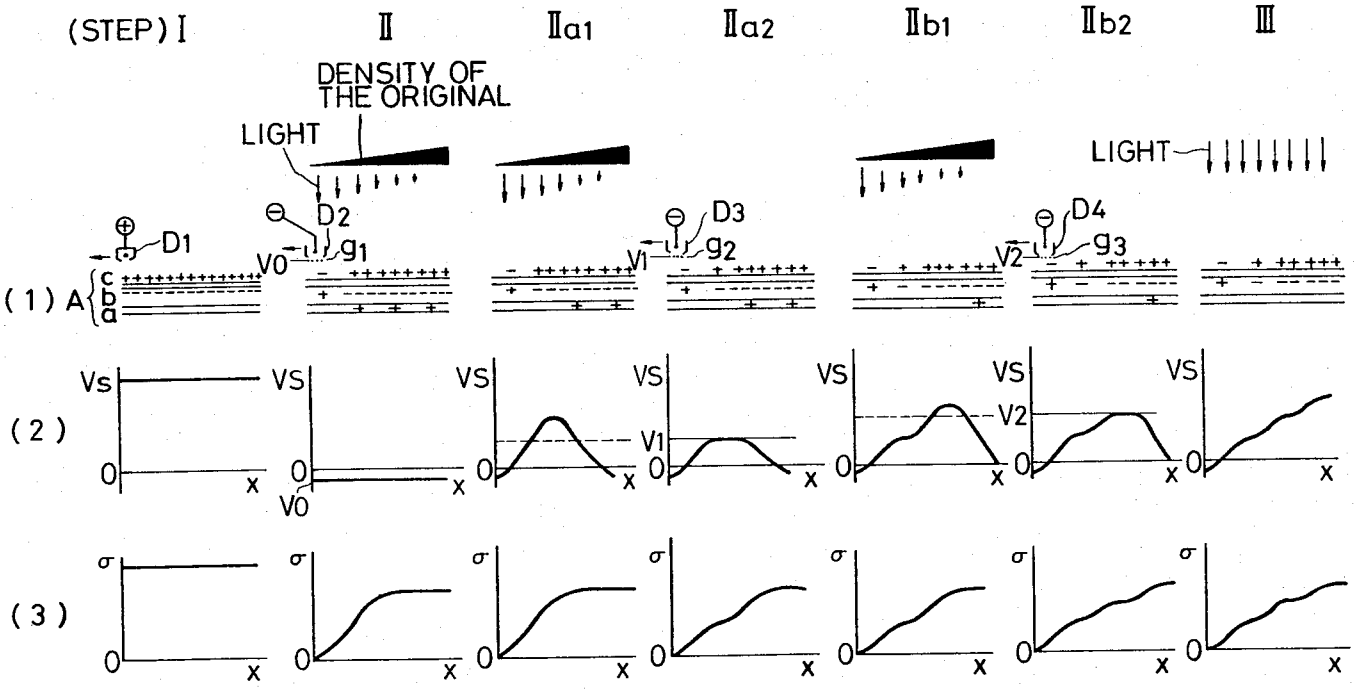
FIG. 1 PRIOR ART
FIG. 1 illustrates the latent image forming process for gradation according to the prior art.

Referring first to FIG. 1, a description will be made of the prior art electrophotographic process as disclosed in the above-referred patent publication. The present invention is directed to improvements in the prior art process.

In FIG. 1, figures in the line (1) schematically show the change of charge on a photosensitive medium A. Figures in the line (2) schematically show the change of surface potential on the photosensitive medium and figures in the line (3) schematically show the change of density of surface charge on the photosensitive medium A corresponding to the density of the original O.

At the first step, step I there is applied onto the surface of the photosensitive medium a primary charge of a selected polarity by a corona discharger D1. The photosensitive medium A is basically composed of an electroconductive substrate a, a photoconductive layer b and a transparent insulating surface layer c. The polarity selected for the primary charge is positive (+) when the photoconductive layer b is of N-type and it is negative (−) when the photoconductive layer is of P-type. In the shown example, a N-type photoconductive layer is used as the layer b.

After the primary charging, the photosensitive medium A is exposed to a light image of the original the image density of which continuously changes at the second step, step II. Simultaneously with the image-wise exposure, discharging is carried out on the photosensitive medium by a corona discharger D2. To this end, a high voltage of the polarity (−) opposite to that of the above primary charge or AC or negatively (−) biased AC is applied to the discharge wire of the corona discharger D2. The corona discharger D2 has a grid g1 provided in the opening portion of the discharger. The applied voltage to the grid is suitably controlled. For discharging at this second step, the voltage is controlled in such manner that after the discharge, the photosensitive medium can have a surface potential Vo adjusted to zero (0) Volt or to slightly negative (−). At this step II, the electric charges captured in the vicinity of the interface between the photoconductive layer and the insulating layer are not released. Nevertheless, in the area where a portion of the surface charge is removed, there are induced in the photoconductive layer some positive holes of the opposite polarity to that of the charge capture near the interface in accordance with the removed charge.

Next to the above step II, the following gradation adjusting steps IIa1 to IIb2 are carried out:

At the step IIa1, the original image is exposed at a suitably controlled intensity of exposure light to release the captured charge on the bright part. The released charge combines with the positive hole induced in the photoconductive layer and disappears. As a result, the surface potential on the bright part changes as shown in FIG. IIa1—(2). On the dark part, the captured charge remains unreleased and therefore there occurs no change of the surface potential on the dark part. Even if there is any change of the surface potential, it is extremely small.

At the next step, step IIa2, the surface potential on the photosensitive medium is adjusted to V1 which is higher than the previous voltage Vo. This is carried out by applying the higher voltage V1 to the grid g2 of a corona discharger D3. The polarity of the discharging voltage applied to D3 to control the surface potential to about V1 is the same as that used at the above step II.

At this step IIa2, the potential on the area where the surface potential has been changed to a level over V1 by the light image exposure at the previous step IIa1 is reduced to about V1 and a portion of the surface charge is removed.

At the next step, step IIb1, the photosensitive medium is further exposed to the original image at a suitably selected intensity of exposure light (for example, at a higher light intensity than that used at step IIa1). By this exposure, the charge on the near-dark part captured in the vicinity of the interface is released. However, on the darkest part, such releasing of the captured charge does not occur because the light can not reach the part of the photosensitive medium. Therefore, the surface potential changes as shown in FIG. IIb1—(2)

At the next step, step IIb2, the photosensitive medium is subjected to the action of corona discharge by a corona discharger D4. During the step, the applied voltage to the grid g3 of the corona discharger D4 is kept at V2 higher than the previously used control voltage V1. The portion of the photosensitive drum A where the surface potential is higher than V2 is selectively discharged and the surface charge on the portion is removed at this discharging step. Thus, after this step, the photosensitive drum has a surface potential curve as shown in FIG. IIb2—(2).

After completing the above gradation adjusting steps, the last step, step III is carried out.

At the step III, the whole surface of the photosensitive medium A is uniformly exposed to light to release all of the charges captured in the interface portion and not bound by the charge on the insulating surface layer. Thereby there is formed on the photosensitive medium an electrostatic latent image whose surface potential is a faithful reproduction of the density contrast of the original image.

If desired, exposure step and discharging step similar to the above steps I and II may be repeated next to the gradation adjusting steps IIa1 and a2 and IIb1 and b2 while gradually increasing the amount of exposure and also increasing the set voltage for the uniformalization of the surface potential.

Also, the steps IIa1, a2 and IIb1, b2 may be carried out at the same time.

In summary, according to the prior art, the reproduction of half-tone can be attained by stepwise increasing the intensity of light image exposure from step II to IIa1 and IIa1 to IIb1 and also increasing the level of the voltage applied to the grid of corona discharger D2, D3, D4 stepwise from step II to IIa2 and from IIa2 to IIb2.

The present invention is directed to improvements in the above described prior art method. The improved method according to the invention enables to realize a better and more reproduction of half-tone. The present invention will be described hereinafter in further detail with reference to FIG. 2 showing an electrophotographic apparatus in which the present invention has been embodied.

Figure 2:
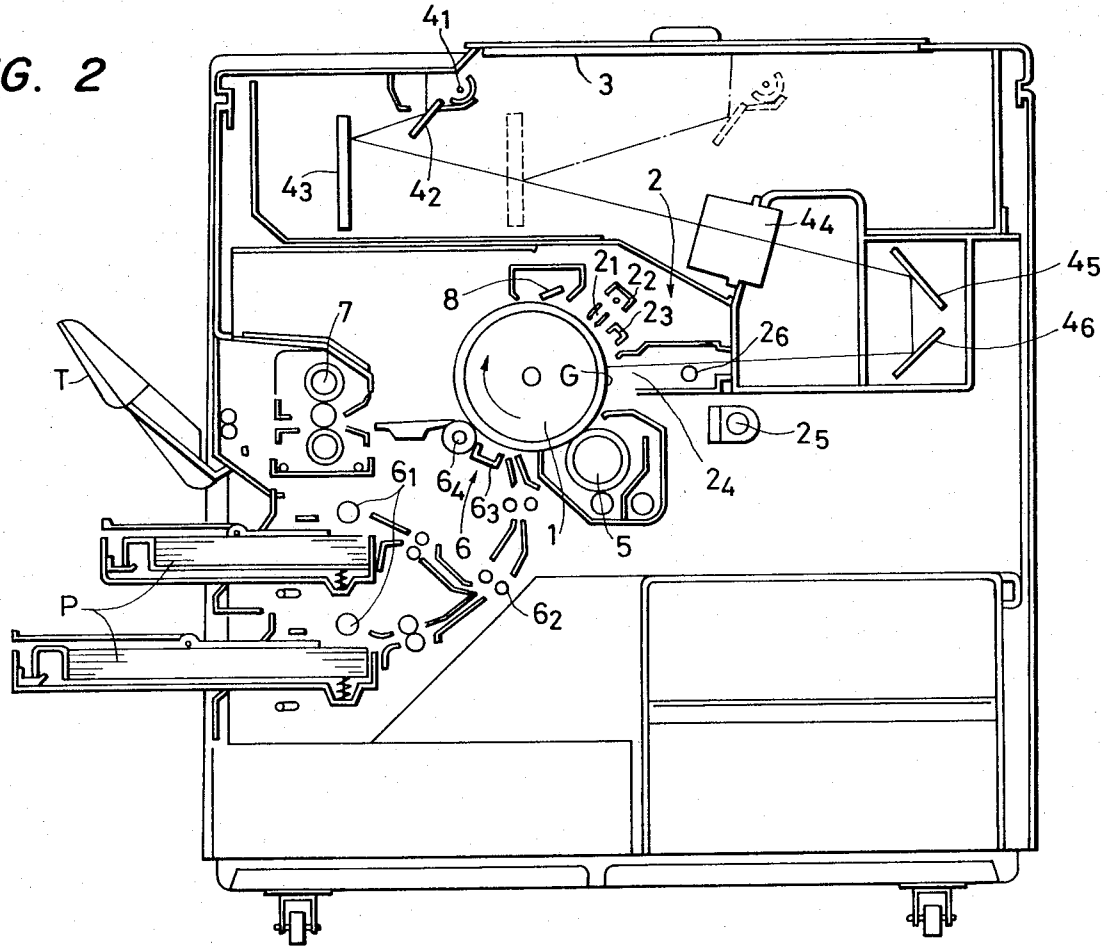
FIG. 2 is a sectional view of the essential part of an electrophotographic copying machine according to the invention.

In FIG. 2, designated by 1 is a photosensitive medium in the form of a rotating drum the structure of which is the same as that shown in FIG. 1. The photosensitive drum 1 again comprises an electroconductive substrate a, a photoconductive layer b and a transparent insulating layer c.

In the shown embodiment, the electroconductive substrate is formed of a plate of metal such as aluminum. As the material for the photoconductive layer there was used cadmium sulfide activated by steel and dispersed in a transparent resin binder. The material is coated on the substrate to form a photoconductive layer of about 50μ thick. Then, a Mylar film of about 25μ thick was bonded to the surface of the photoconductive layer by means of adhesive.

Around the photosensitive drum there are disposed various processing means of which 2 is latent image forming means. Said latent image forming means includes an AC charger $2_1$ and a pre-exposure lamp $2_2$ to erase the hysteresis of the photosensitive medium 1 whereby any irregularity of image quality during a continuous copying operation can be avoided.

$2_3$ is a primary charger for uniformly charging the surface of the photosensitive medium 1. By the primary charge, the surface potential on the drum 1 is set to about +1500 V. 3 is an original table on which an original is placed. An image of the original is exposed onto the photosensitive drum 1 by means of exposure means. Exposure means includes an illuminant $4_1$ for illuminating the original table 3, mirrors $4_2$ and $4_3$ moving together with the illuminant to scan the original surface, an optical lens $4_4$ for forming a light image of the original and stationary reflecting mirrors $4_5$ and $4_6$ for guiding the light image to the drum surface. Disposed on the optical path is a bias light source $2_6$ for white light or near-infrared light. When necessary, the bias light source is switched ON simultaneously with the original exposure.

$2_4$ is a corona discharge of negative polarity which is used simultaneously with the light image exposure to form a latent image. At the opening of the corona discharger there are arranged control grid groups to which various determined voltages are applied to set various different potentials required to perform the gradation control according to the invention as will be described in detail later.

$2_5$ is a whole surface exposure lamp by which the entire surface of the photosensitive medium 1 is uniformly exposed to form an electrostatic latent image thereon. The surface potential of the electrostatic latent image is −50 to −100 V on the bright part and +300 to +500 V on the dark part.

After forming the latent image, developer is applied onto the photosensitive drum by a sleeve type magnetic brush developing device 5. The developed image is then transferred onto a transfer sheet P from the photosensitive drum 1 by paper feeding and transferring means 6 including a transfer corona discharger $6_3$. The transferred image on the transfer material P is melted and fixed to the transfer material P by a heat-fixing device 7. After fixing, the transfer sheet is discharged into a paper discharge tray T. On the other hand, after transferring, the photosensitive drum 1 enters a cleaning station where any remaining developer on the drum is removed off by a cleaning device 8 to prepare the photosensitive medium 1 for the next image forming process.

The detailed structure of the above mentioned corona discharger $2_4$ will be described hereinafter with reference to FIGS. 3A to 3C.

Figure 3A:
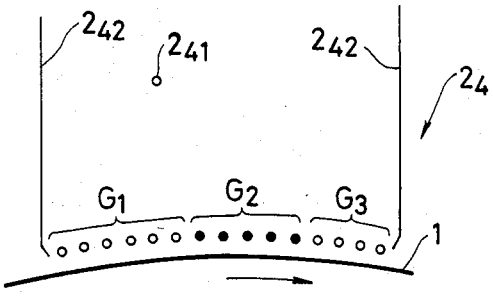
FIG. 3A is a cross-section of the charger for discharging with simultaneous exposure.

FIG. 3A is an enlarged cross-section of a portion of the corona discharger $2_4$. As previously mentioned, this corona discharger $2_4$ is used simultaneously with the exposure of light image of the original.

As schematically shown in FIG. 3A, the corona discharger $2_4$ has a plurality of grid wires disposed at regular intervals (for instance at intervals of about 1 mm) and extending in the direction perpendicular to the direction of rotation of the drum 1. The grid wire group is suitably spaced from the drum surface 1 (for instance about 1 mm).

The grid wires are divided into three grid groups, G1, G2 and G3. The grid group G1 is on the side of the primary charger. Different bias voltages are applied to the three grid groups. In the shown embodiment, about −100 V was applied to G1, about +100 V to G2 and ground potential to G3. In FIG. 3A, $2_{41}$ is a discharge wire of the corona discharger and $2_{42}$ is a shield plate thereof.

After uniformly charged with a selected polarity by the above primary charger $2_3$, the photosensitive drum 1 is subjected to the discharging action of the opposite polarity corona discharger $2_4$ simultaneously with image-wise exposure. At the time, the discharger $2_4$ acts on the photosensitive drum in the following manner:

At first, corona passed through the grid group G1 with −100 V being applied thereto effects discharging of the photosensitive drum.

Secondly, corona passed through G2 with +100 V being applied thereto effects discharging of the drum.

Thirdly, corona passed through the grounded grid group G3 effects discharging of the drum.

After completing the above discharging by the corona discharger $2_4$, the whole surface of the photosensitive drum is uniformly exposed to light by the lamp $2_5$. Thus, a desired electrostatic latent image is formed on the drum surface.

Figure 4A:
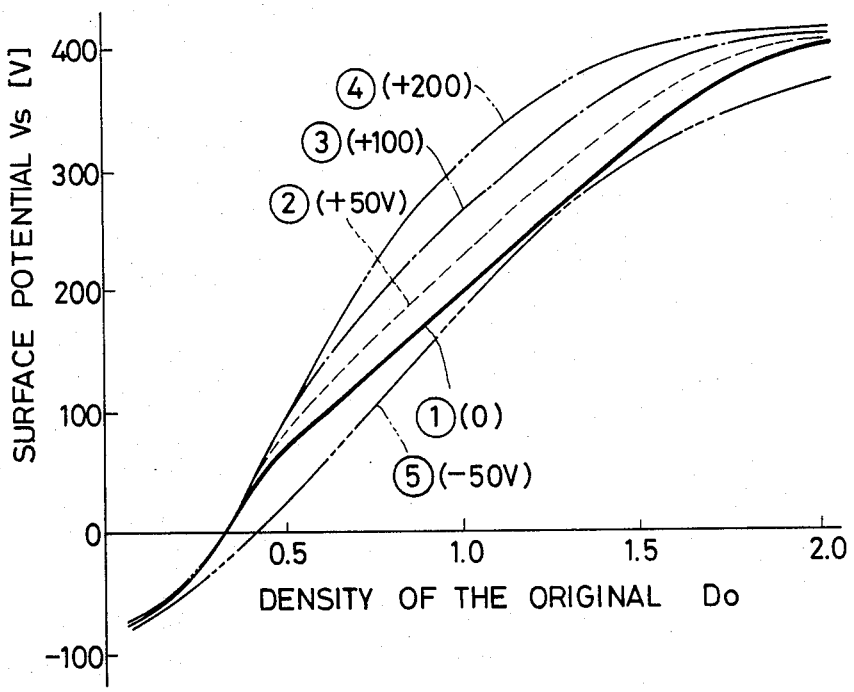
FIGS. 4A and 4B are relation curves between density of original and surface potential showing the effect of the invention.

FIG. 4A shows the relation between the density of original Do and the surface potential Vs formed on the photosensitive medium 1 at the corresponding original density Do. The solid line relation curve ① is that obtained from the electrostatic latent image formed employing the above embodiment of the invention. Compared with other curves ② to ⑤ in FIG. 4A it is obvious that the reproducible range of brightness was remarkedly broadened by the apparatus according to the invention. The brightness reproducible range attained by the apparatus according to the invention is about 1.6. Other curves shown in FIG. 4A, broken line curve ②, one-dotted chain line ③, two-dotted chain line ④ and three-dotted chain line ⑤ were obtained when the applied bias voltage to the grid group G3 (FIG. 3A) was changed to +50 V, +100 V, +200 V and −50 V respectively while keeping the applied bias voltages to G1 and G2 constant at −100 V and +100 V. The cases wherein +100 V and +200 V were applied to G3 (curves ③ and ④) correspond to the gradation controlling method according to the prior art as previously described in detail. FIG. 4A demonstrates that the gradation reproducibility attainable by the prior art method is lower than that attained by the present invention.

From FIG. 4A it is also seen that the characteristic curve ① according to the embodiment of the present invention has a clear and sharp inflection point at area near $Vs=60$–$70$ $V$. In curve ② such inflection point is vague and it becomes more vague in curve ③. In curve ④ such inflection point is entirely lost, and curve ⑤ has no inflection point either.

The reproducible ranges of brightness for curves ②, ③, ④ and ⑤ were 1.5, 1.3, 1.2 and 1.3 respectively. Gradients at the area near 0.6 of original density Do for curves ①, ②, ③, ④ and ⑤ were 20 V, 25 V, 40 V, 65 V and 35 V respectively. Since the gradient represents potential change per unit original density, 0.1, a larger value of the gradient means a harder tone. The larger the value, the more difficult it is to reproduce half-tone.

Therefore, the effectiveness of the used gradation control can be evaluated in two terms, brightness reproducibility range and gradient of latent image characteristic curve at near 0.6 of original density. When the above curves ① to ⑤ are evaluated in this manner, the curve ① gets the best score. Curves ②, ⑤, ③ and ④ are in the second, third, fourth and fifth rank respectively.

In other words, the highest effect of gradation control is obtained without any fogging on the background part of the original when the applied bias voltages VG1, VG2 and VG3 to grids G1, G2 and G3 of the corona discharger in FIG. 3A satisfy the condition of [VG1<VG3<VG2].

In the case shown in FIG. 4A, +100 V was applied to the grid G2. However, it is to be understood that any voltage selected from the range from 0 to +300 V can be applied to G2 without losing the conditional relation among VG1, VG2 and VG3. According to the applied voltage to the grid G2, the corona discharge current useful for discharging decreases or substantially stops its action.

Figure 3B:
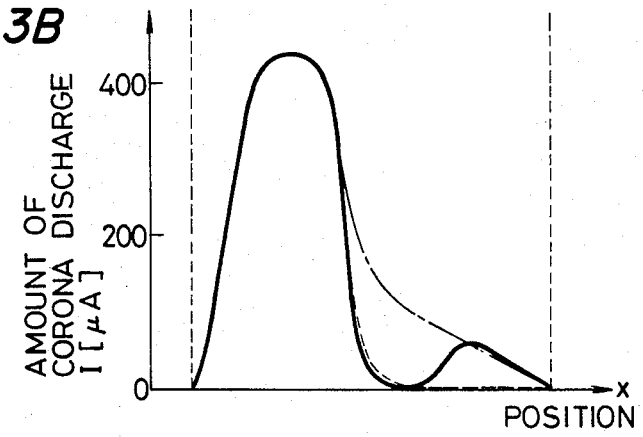
FIG. 3B is a graph showing the distribution of amount of corona discharge on the photosensitive medium within the width of the charger.
Figure 3C:
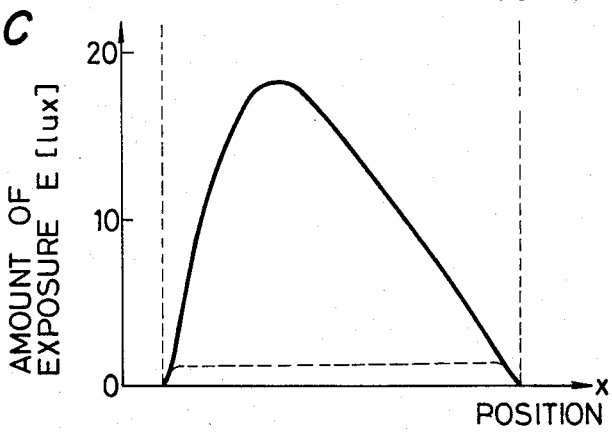
FIG. 3C is a graph showing the distribution of amount of exposure within the width of the charger.

FIGS. 3B and 3C show the distribution of corona discharge and the distribution of illuminance for the charger $2_4$ shown in FIG. 3A.

All of the curves in FIG. 3B are curves showing the distribution of corona discharge current on the photosensitive drum surface by the charger $2_4$ of which the solid line curve was obtained when −100 V, +100 V and 0 (zero)V were applied to the grids G1, G2 and G3 respectively while applying −8.5 KV to the discharge wire $2_{41}$. The broken line curve was obtained when −100 V, +100 V and +100 V were applied to G1, G2 and G3 respectively. The chain-dotted line curve was obtained when −100 V, 0 V and 0 V were applied to G1, G2 and G3 respectively. As seen from the solid line curve or broken line curve, the corona discharge current is abruptly blocked out when +100 V is applied to the grid G2. In the case wherein the grid G3 was at ground potential, there was produced a small distribution of passed corona discharge current on the corresponding area as seen in the solid line curve. In the shown embodiment, the times which a point on the drum surface took to pass over the grids G1, G2 and G3 were 0.12 sec., 0.10 sec. and 0.08 sec. respectively.

In FIG. 3C, the solid line curve is a distribution curve showing the distribution of illuminance of light exposed on the photosensitive drum through the charger $2_4$ shown in FIG. 3A (an original the background of which was white was used). The broken line curve shows the distribution of bias exposure. The bias exposure is used, when it is required, simultaneously with image-wise exposure. By the bias exposure, the photosensitive drum surface is uniformly illuminated. When white light is used, the illuminance of the bias exposure is generally less than 1/10 of the simultaneous image-exposure and less than 1/50 of the whole surface exposure at step III shown in FIG. 1. Also, when near-infrared light is used for the bias exposure, the level of the illuminance is similar to the above.

Figure 4B:
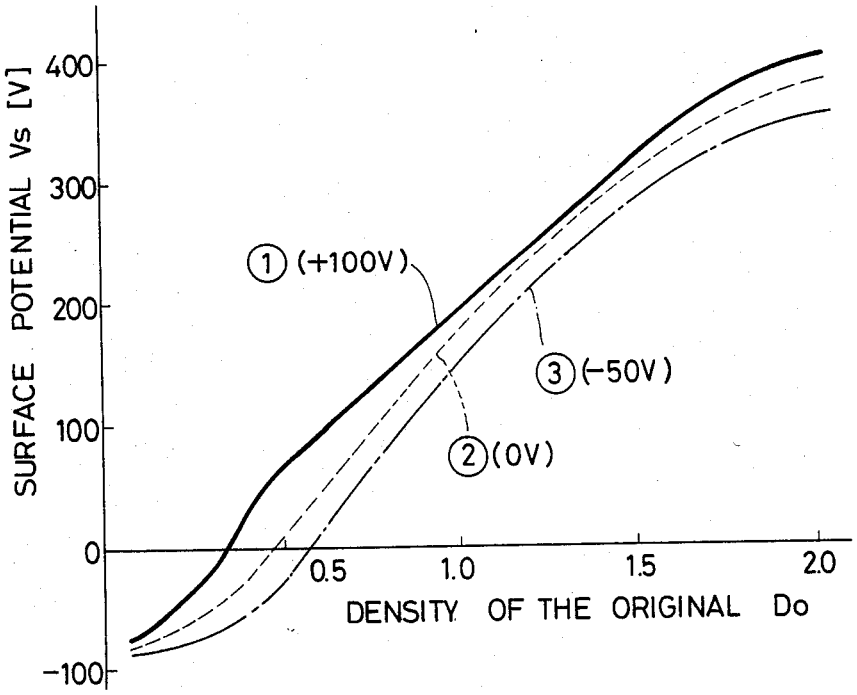

FIG. 4B shows relation curves between original density and surface potential on the photosensitive drum as obtained when only the bias voltage applied to G2 was changed while keeping constant the bias voltages to G1 and G3 at −100 V and 0 V respectively. Of the three curves shown in FIG. 4B, the solid line curve ① is of the present invention shown in FIG. 3A. The broken line curve ② is that obtained when the grid G2 was set to −0 V and the chain-dotted line curve ③ is that obtained when the grid G2 was set to −50 V.

As seen from FIG. 4B the two curves ② and ③ do not have any inflection point while the curve ① has a point of inflection which serves to prevent fogging on the bright part. Furthermore, the brightness reproducible ranges of the curves ② and ③ and are 1.3 and 1.2 which are lower than that of the curve ① which is 1.6. As previously described, the gradient of the curve at original density Do=about 0.6 (the amount of potential change [V] per original density unit, 0.1) gives a measure for the evaluation of gradation reproducibility. The values of the gradient of the curves ①, ② and ③ were 20 V, 30 V and 35 V respectively. From the above points it is concluded that the curve ① is the best in effect on gradation reproducibility, the curve ② is the second and curve ③ is the third in the effect.

The reasons for the above difference in gradation reproducibility as shown in FIGS. 4A and 4B may be explained as follows:

We explain at first such case wherein after the second exposure with simultaneous discharging through the grid G2 of the corona discharger $2_4$, the whole surface exposure shown in FIG. 1, Step III was carried out without carrying out the third exposure with simultaneous discharging through the grid G3. In this case, the gradation characteristic of latent image obtained was worse than the curve ④ in FIG. 4A. The reason for this is as follows:

In order to obtain the proper bright part potential (about −80 V) on the photosensitive drum, about 3 lux. sec. of exposure should be given to the drum through the grid G1 shown in FIG. 3A. Calculating from the illuminance distribution in FIG. 3B, when the amount of exposure by G1 is 3 lux. sec., the corresponding exposure by G2 is 3 lux.×60%=1.8 lux. sec. Therefore, the exposure given to the area corresponding to 0.8 of original density by the second exposure through the grid G2 (corresponding to Step IIa1 in FIG. 1) becomes: 1.8 lux. sec.×1/6.3=0.29 lux. sec.

Figure 5:
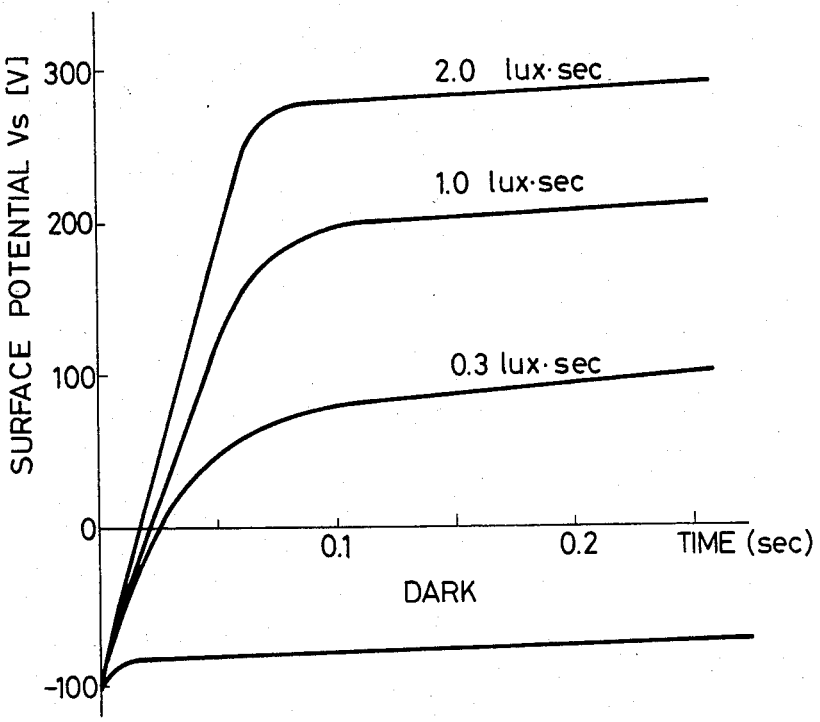
FIG. 5 is a graph showing the characteristic of rising of surface potential after exposure.

FIG. 5 is a graph showing the change of surface potential to time passed after the first exposure given to the area corresponding to 0.8 of original density at Step II in FIG. 1.

In FIG. 5 there are shown four characteristic curves of which one (Dark) shows the characteristic in dark after the first exposure and the remaining three curves are those obtained when different uniform exposures (0.3, 1.0 and 2.0 lux. sec.) were given after the first exposure.

The rising speed of surface potential increases up with increasing of the amount of uniform exposure. When the amount of uniform exposure was in the range of 0.3 to 1.0 lux. sec., the rising time required to reach the balanced state of the surface potential was about 0.1 seconds. Of course, this rising time varies depending on the mobility of carrier and therefore, different photosensitive mediums have different rising times. However, in most photosensitive medium generally used in common copying machines, the value of rising time is not so far different from the above value.

Therefore, in the case where the discharging time by the grid G2 is 0.1 sec. (under the condition that the processing speed is 120 mm/sec. and the width of the grid G2 is 12 mm) for about 0.3 lux. sec. of the second exposure by G2, the local rise of surface potential corresponding to Step IIa1 in FIG. 1 becomes lower than 100 V as seen from the characteristic curve in FIG. 5. Consequently, in this case, the discharging through G1 can not be effected substantially or the effect for discharging is very small. For this reason, there is obtained only poor effect for faithful reproduction of gradation.

The effect on gradation control is improved by the third exposure with simultaneous discharging through grid G3 carried out about 0.1 sec. after the first exposure. However, it has been found that the third exposure with simultaneous discharging has a sufficient effect to improve the gradation reproducibility only when the applied bias voltage to G3 is lower than that to G2. This may be attributable to the fact that the distribution of illuminance corresponding to G3 is small. Therefore, the effect of discharging corresponding to Step IIa2 in FIG. 1 must be sufficiently increased up by decreasing down the applied bias voltage to G3 thereby increasing the corona discharge current passing through it.

However, if the bias voltage to G3 is set to a value close to the voltage of the grid G2 lying on the upstream side of G3, it is no longer possible to selectively discharge the area of particularly selected density of the original image. As a result, there will be such characteristic curve having no inflection point for the prevention of fog generation as in the case of the curve ⑤ in FIG. 4A.

When the voltage of the grid G2 was set a value less than OV, that is, a value close to the negative bright part potential, there was effected a sufficient discharging through G2 at the second exposure with simultaneous discharging even when the local rise of potential at Step IIa1 in FIG. 1. However, in this case, like the case of the curve ⑤ in FIG. 4A, an excessive discharging was caused by it over the area from low density portion to high density portion of the original whereby the selective discharging for selected density area of the original was rendered difficult to attain. Thereby the necessary clear inflection point was lost in the latent image characteristic curve and the characteristics of the latent image obtained was shifted toward the negative polarity side as a whole.

Figure 6:
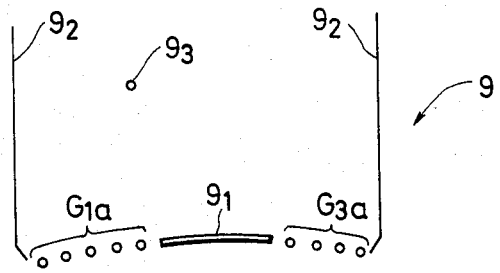
FIG. 6 is a cross-section of another secondary charger according to the invention.

FIG. 6 shows another embodiment of the charger according to the invention.

The charger 9 shown in FIG. 6 is different from the charger $2_4$ shown in FIG. 3 in the point that the grid G2 in FIG. 3 was replaced by a tranparent plastic plate $9_1$ disposed extending over the full length of the grid and spaced from the photosensitive drum surface by about 1 mm. Grids G1*a* and G3*a* of the charger 9 correspond to G1 and G3 of the charger $2_4$ of the above embodiment. The bias voltages selected for the grids G1*a* and G3*a* of the second embodiment were −100 V and 0 V respectively. The second exposure corresponding to Step IIa1 in FIG. 1 was carried out on the drum surface through the transparent plate $9_1$.

Figure 7:
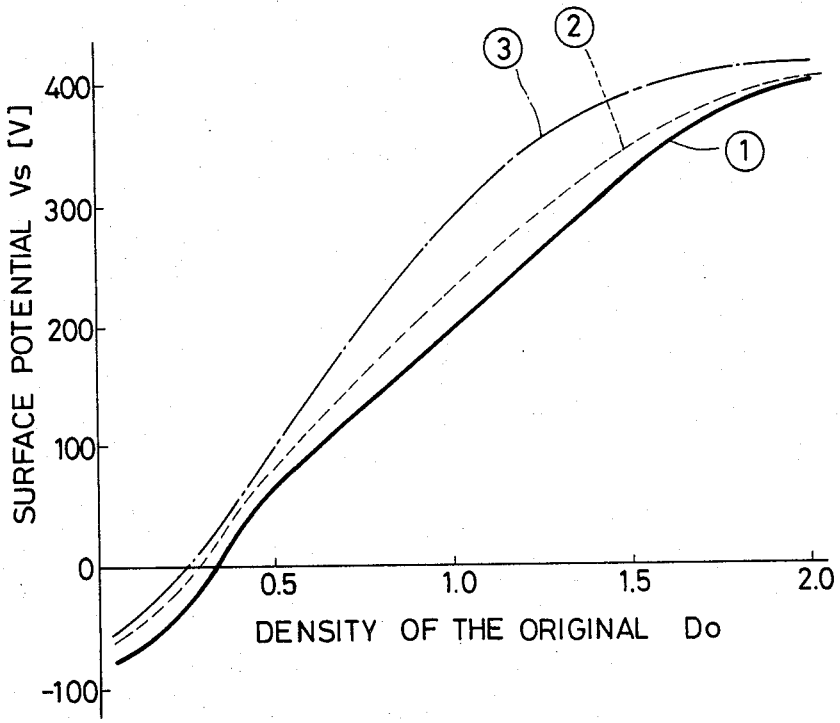
FIG. 7 is a relation curve between density of original and surface potential showing the effect of the invention.

FIG. 7 shows the characteristic curve of the latent image obtained by this second embodiment in broken line ② together with the solid line curve ① previously shown in FIG. 4 for the sake of comparison. As seen from FIG. 7, the latent image characteristic curve ② according to the second embodiment is similar in shape of curve to the curve ① according to the above described first embodiment. However, as a whole, the potential of the former is higher than the latter. This means that in the case of the curve ② the sensitivity is lowered as compared with the case of the curve ①. Further, the curve ① has a clear inflection point whereas the curve ② does not have such clear inflection point. Despite of these differences, the brightness reproducible range attained by the second embodiment is relatively good, which was found to be 1.45.

For the second embodiment provided with a transparent plate $9_1$ in the charger it is required to take into account some adverse effects such as caused by the charge-up of the transparent plate or dirt on it. For the purpose of comparison, the transparent plate $9_1$ was replaced by an opaque plastic plate. The characteristic curve in chain-dotted line ③ in FIG. 7 show the characteristics of the latent image obtained when the plastic plate $9_1$ was opaque. As compared with the curve ② obtained when the plastic plate $9_1$ was transparent, the curve ③ shows a higher increasing rate of potential from the original density area nearly corresponding to the inflection point of the curve ①. Further the linearity of the characteristic curve is reduced. The brightness reproducible range was dropped down to 1.3.

Designated by $9_2$ in FIG. 6 is a shield plate and $9_3$ is a corona wire to which the same voltage is applied as in FIG. 3.

Figure 8A:
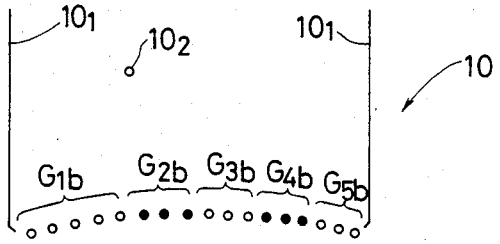
FIGS. 8A and 9A show other embodiments of the charger according to the invention.

FIG. 8A shows a further embodiment using a charger for discharging 10 having five grid groups G1*b* to G5*b*.

Figure 8B:
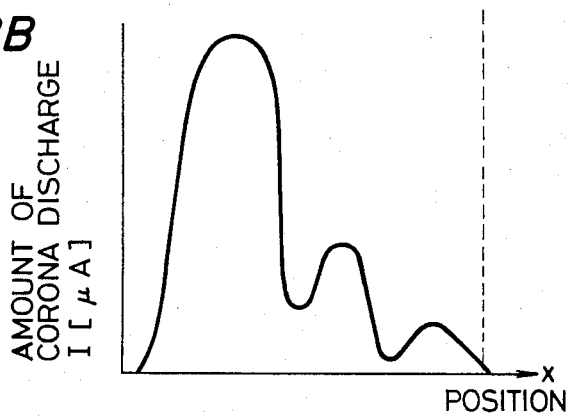
FIGS. 8B and 9B are graphs showing the distribution of amount of corona discharge within the width of the above embodiments respectively.

In FIG. 8A, $10_2$ is a corona wire and $10_1$ is a shield casing. In the embodiment, −100 V, 0 V, −50 V, +50 V and 0 V were applied to the five grid groups, G1*b*, G2*b*, G3*b*, G4*b* and G5*b* respectively. Through these five grid groups, a corona discharge current was applied onto the photosensitive drum surface. FIG. 8B shows the distribution of the corona discharge on the drum surface (which was at ground potential) obtained when the applied voltage to the corona discharge wire $10_2$ was −8.0 KV. When the charger 10 was used to the apparatus shown in FIG. 2, (with a bias exposure together with image-wise exposure as previously mentioned), there was obtained a high brightness reproducible range which reached about 1.8.

Figure 9A:
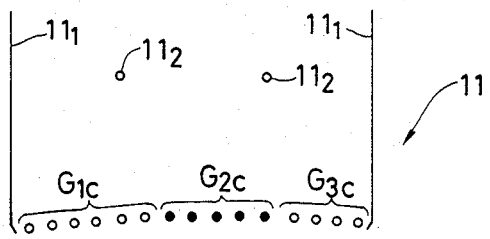
Figure 9B:
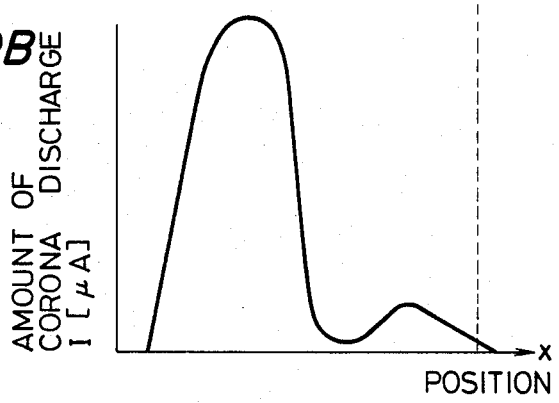

FIG. 9A shows a further embodiment in which a charger 11 having two corona discharge wires $11_2$ is used.

In this embodiment, the grid is divided into three groups G1*c*, G2*c* and G3*c*. $11_1$ is a shield plate. When the charger 11 was used for discharging, it was found that a higher bias voltage was required to apply to G3*c* than the bias voltage required for the charger shown in FIG. 3. This may be explained by the fact that this embodiment has two discharge electrodes one of which is located in the vicinity of the grid G3*c* and the negative corona discharge is enhanced by it. The distribution of corona discharge current given to the photosensitive drum surface through the grid groups of the embodiment is shown in FIG. 8B. The brightness reproducible range of latent image attained by this embodiment was 1.5 which is slightly lower than that attained by the charger shown in FIG. 3.

In this manner, according to the invention, the gradation reproducibility is improved by rendering the surface potential abruptly decayed at the step of image-wise exposure corresponding to Step IIa1 or IIb1 in FIG. 1. To this end, according to the invention, the grid bias voltage of the secondary charger for carrying out discharging next to the primary charging is controlled so as to form a desired distribution of corona discharge current applied to the drum surface through the grid groups.

The gradation control method according to the invention is applicable also to electrophotographic color copying apparatus. However, when it is applied to a color copying machine, the effect of gradation control is not always the same for all of color separation exposures in blue, green and red. For instance, some difference may be produced in the sharpness of inflection point and also in the original density at which the inflection point appears. Probably this phenomenon may be attributable to the fact that the exposures in blue, green and red have different effects each other due to the presence of space charge in the photoconductive layer. It has been found to be advisable that the bias voltage to the grid G2 in FIG. 3 should be controlled independently of other colors to control the characteristics of the respective color separation latent image.

Figure 10:
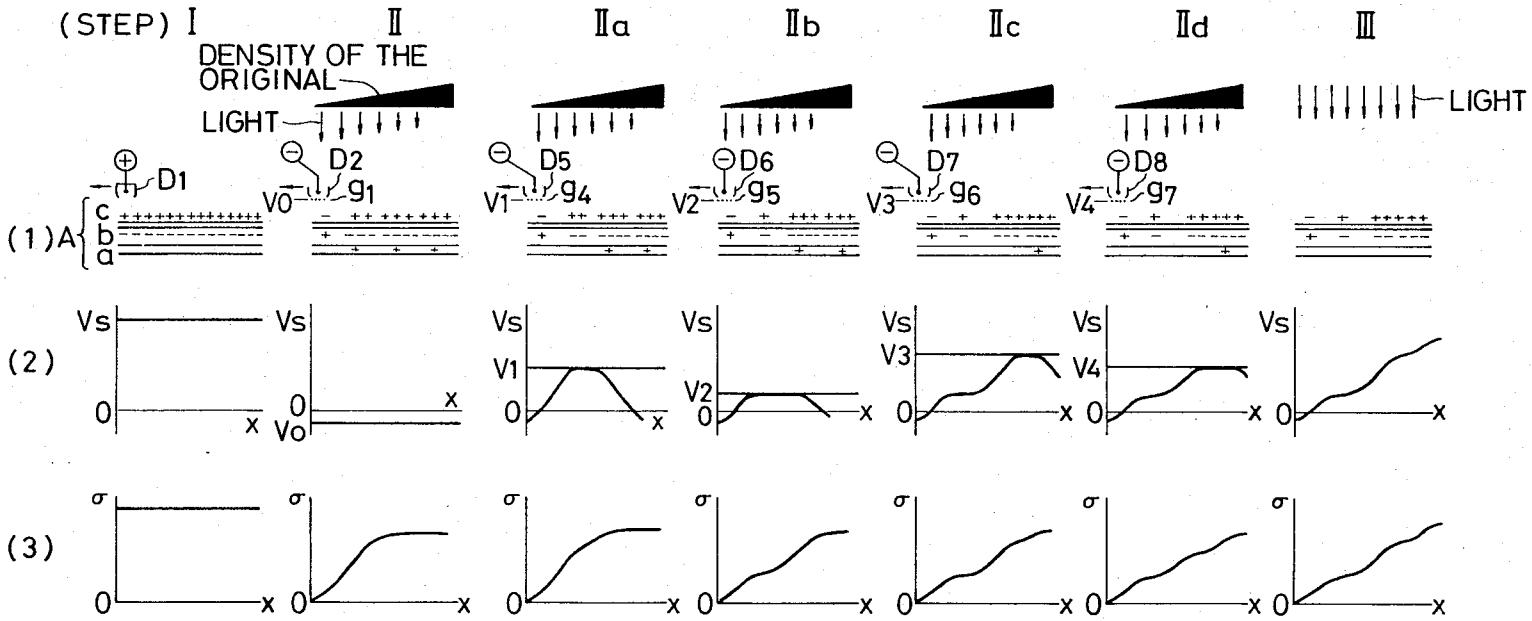
FIG. 10 illustrates the latent image forming process according to the invention.

FIG. 10 illustrates the latent image forming process according to the invention. Similarly to FIG. 1, figures in the line (1) show the change of electric charge on the photosensitive medium A. Figures in the line (2) show the change of surface potential on the photosensitive medium A. Figures in the line (3) show the change of the density of surface charge on the photosensitive medium A. The photosensitive medium A has the same characteristics as that in FIG. 1.

FIG. 10 illustrates, among others, the process using the form of grid shown in FIG. 8A. Therefore, chargers $D_5$ to $D_8$ shown in FIG. 10 correspond to the corona discharger of corona wire $10_2$ in FIG. 8A. Grids g1 to g7 in FIG. 10 correspond to the grid groups G1*b* to G5*b* of the charger shown in FIG. 8A. Therefore, in the case where the charger shown in FIG. 3A is used, the whole surface exposure step, Step III is carried out after completing the steps II, IIa and IIb.

As seen from FIG. 10, at step I the surface of the photosensitive medium A is uniformly charged (primary charging step). Following the primary charge step, the uniform charge on the surface is selectively reduced. The process shown in FIG. 10 is characterized by the provision of Step IIa which is carried out next to the corona discharge step (Step II). At step II, the surface of the photosensitive medium A is subjected to the action of corona discharge of opposite polarity to the polarity of the primary uniform charge. At the next step, Step IIa, the surface is image-wise exposed while reducing or stopping the action of the opposite corona discharge on the photosensitive medium. By the step IIa, the potential of half-tone part is sufficiently increased up. In the state of this sufficiently high potential on the half-tone part, the next step (Step IIb) is started to selectively discharge the half-tone part only by the action of opposite polarity corona. Since the half-tone part discharging step (Step IIb) is carried out after the potential on the half-tone part has been sufficiently increased up by Step IIa, there can be obtained a desired potential curve of the half-tone part without being affected by the sensitivity of the photoconductive layer, the amount of exposure etc. and thereby the linearity of the curve is greatly improved as compared with the prior art process.

In other words, according to the above shown process of the invention, the rising of the potential on the half-tone part is assured by Step IIa prior to Step IIb. Thus, a potential curve as the curve ① in FIG. 4A can be obtained. If corona ions can not reach the photosensitive medium at the position of grid G2 (FIG. 3A) as may occur in FIG. 6 embodiment, the discharging by grid g4 at Step IIa can not be effected. In this case, the half-tone part gets in the state of slightly under-discharged. As a result, there is obtained a potential curve as shown by the curve ② in FIG. 7, in which the potential on the half-tone is somehow too high. But, it exhibits also sufficiently high reproducibility of gradation.

Image-wise exposure related to the grid G3 or G3*a* of the charger shown in FIG. 3A or FIG. 6 is not always necessary if the photoconductive layer of the photosensitive medium has good property of light memory. Since the light to which the photosensitive medium has previously exposed can be memorized in the photoconductive layer, the photosensitive medium remains substantially in the same state as subjected to an exposure of light image at the next step. Therefore, at the position of grid G3 or G3*a*, the photosensitive medium surface can be discharged to a determined potential without simultaneous image-wise exposure.

While the invention has been particularly shown and described with reference to preferred embodiments thereof, it is to be understood that the invention is not limited thereto but may be otherwise variously embodied within the scope of the appended claims.

We claim:

1. A process for forming an electrostatic latent image on a photosensitive medium having an electroconductive layer, a photoconductive layer and an insulating surface layer, the process comprising the steps of:

(a) uniformly charging the insulating surface layer of said photosensitive medium with a selected polarity;

(b) subjecting said photosensitive medium to corona discharge having a component of opposite polarity to that of the uniform charge of step (a) while exposing said photosensitive medium to a light image;

(c) increasing the surface potential on said photosensitive medium at the half-tone area of the light image by applying a light image exposure onto said photosensitive medium;

(d) subjecting said photosensitive medium to corona discharge having the component of opposite polarity to that of the uniform charge of step (a) under the effect of light image exposure thereby discharging a portion of the surface potential of the half-tone area previously increased at step (c) so as to decrease the surface potential on said photosensitive medium previously obtained at step (c); and (e) exposing said photosensitive medium to uniform light.

2. An electrostatic latent image forming process according to claim 1, wherein at the step (c) of light image exposure, a corona discharge is applied onto said photosensitive medium simultaneously with said light image exposure while controlling the amount of corona discharge.

3. A process for forming an electrostatic latent image on a photosensitive medium having an electroconductive layer, a photoconductive layer and an insulating surface layer, the process comprising the steps of:

(a) applying a uniform first charge to the insulating surface layer of said photosensitive medium with a selected polarity;

(b) subjecting said photosensitive medium to a second charge using a corona discharge having the component of opposite polarity to that of the uniform charge of step (a) while exposing said photosensitive medium to a light image whereby the surface potential on said photosensitive medium is rendered opposite in polarity to that of the uniform charge of step (a);

(c) increasing the surface potential on said photosensitive medium at the half-tone area of the light image by applying a light image exposure onto said photosensitive medium and then applying to said photosensitive medium a third charge, said third charge being applied through a grid using a corona discharge having the component of opposite polarity to that of the uniform first charge of step (a) thereby discharging a portion of the surface potential on the half-tone area previously increased;

(d) applying to said photosensitive medium, through said grid, a fourth charge using corona discharge having the component of opposite polarity to that of the uniform charge of step (a), said fourth charge being applied under the effect of light image exposure thereby decreasing the surface potential of the half-tone area previously obtained at step (c); and (e) exposing said photosensitive medium to uniform light.

4. An electrostatic latent image forming process according to claim 3, wherein voltages are applied to the grid members at steps (c) and (d) and wherein the applied voltage of the grid member at the step (d) decreases the surface potential as compared to the voltage applied to the grid member at the step (c).

5. An electrostatic latent image forming process according to claim 4, wherein a bias voltage of the same polarity as that used at the step (a) is applied to the grid member at the step (c) and the grid member at the step (d) is set to 0 (zero) potential.

6. A process for forming an electrostatic latent image on a photosensitive medium having an electroconductive layer, a photoconductive layer and an insulating surface layer, the process comprising the steps of:

(a) uniformly charging the insulating surface layer of said photosensitive medium with a selected polarity;

(b) subjecting said photosensitive medium to corona discharge having the component of opposite polarity to that of the uniform charge at the step (a) while exposing said photosensitive medium to a light image;

(c) increasing the surface potential on said photosensitive medium at the half-tone area of the light image by light image exposure;

(d) subjecting said photosensitive medium to corona discharge having the component of opposite polarity to that of the uniform charge at the step (a) under the effect of light image exposure thereby discharging a portion of the surface potential of the half-tone area previously increased at step (c) so as to decrease the surface potential on said photosensitive medium previously obtained at step (c); and (e) exposing said photosensitive medium to uniform light, said steps (c) and (d) being repeated a plural number of times.

7. Apparatus for forming electrostatic latent images on a photosensitive medium, said apparatus comprising:

(a) an endless moving photosensitive medium having an electroconductive layer, a photoconductive layer and an insulating surface layer;

(b) optical means for guiding a light image to said photosensitive medium;

(c) means for applying a first charge for uniformly charging the insulating surface layer of said photosensitive medium with a selected polarity;

(d) corona charging means for applying a second charge to said photosensitive medium using corona having the component of opposite polarity to that of the uniform charge with simultaneous imagewise exposure;

(e) corona charging means for applying corona having the component of opposite polarity to that of the uniform charge under the effect of light image exposure to decrease the surface potential on the photosensitive medium as compared to such potential effected by said means for applying said second charge;

(f) guiding means provided between the corona charging means for applying said second and third charge for guiding the light image to the downstream side of said charging means for applying said second charge; and (g) illumination means for uniformly exposing said photosensitive medium to light.

8. Apparatus as set forth in claim 7, wherein means (d) to (f) constitute a corona charger.

9. Apparatus as set forth in claim 8, wherein said corona charger means (d) and (e) include grid members disposed between said photosensitive medium and a corona source of opposite polarity to that of the means for applying the first uniform charge.

10. Apparatus as set forth in claim 9, wherein a bias voltage of opposite polarity to that of the uniform charge in (c) is applied to the grid member in (d), a voltage of opposite polarity to that of the grid member in (d) is applied to the grid member in (f) and a voltage between the applied voltage to the grid member in (d) and the applied voltage to the grid member in (f) is applied to the grid member in (e).

11. Apparatus as set forth in claim 10, wherein the grid member in (e) is at 0 (zero) potential.

12. Apparatus as set forth in claim 7, wherein said means in (d) and (e) include grid members disposed between said photosensitive member and a corona source of opposite polarity to that of the uniform charge in (c), and means (f) further includes a transparent plate disposed therebetween.

13. Apparatus as set forth in claim 8, wherein said corona charger is an AC corona charger.

14. Apparatus as set forth in claim 8, wherein said corona charger is a DC corona charger.

* * * * *

UNITED STATES PATENT AND TRADEMARK OFFICE

CERTIFICATE OF CORRECTION

PATENT NO. : 4,494,856

DATED : January 22, 1985

INVENTOR(S) : TAKAO AOKI, ET AL.

It is certified that error appears in the above-identified patent and that said Letters Patent is hereby corrected as shown below:

COLUMN 1

Line 34, "complicate" should read -- complicated --,

Line 40, after "of" insert --an--.

Line 42, after "with" insert --a--.

COLUMN 2

Lines 16, 19 and 28, after "of" isnert --the--.

Line 34, after "of" (first occurrence) insert --the--.

COLUMN 3

Lines 17 and 18, "capture" should read --captured--.

COLUMN 4

Line 9, before "exposure" insert --the--.

Line 26, "to realize" should read --the realization of--.

COLUMN 8

Line 26, delete "up".

Line 27,"increasing" should read --an increase--.

Line 34, "medium" should read --media--.

Line 58, delete "up".

Line 59, delete "down".

COLUMN 9

Line 5, "when" should read --with--.

Line 43, delete "of".

UNITED STATES PATENT AND TRADEMARK OFFICE

CERTIFICATE OF CORRECTION

PATENT NO. : 4,494,856

DATED : January 22, 1985

INVENTOR(S) : TAKAO AOKI, ET AL.

It is certified that error appears in the above-identified patent and that said Letters Patent is hereby corrected as shown below:

COLUMN 9

Line 47, after "charger" insert --,--.

Line 65, "discharging" should read --discharger--.

COLUMN 10

Line 50, after "effects" insert --on--.

Line 52, after "voltage" insert --applied--.

COLUMN 11

Lines 20 and 26, delete "up".

Lines 36 and 39, "can not" should read --cannot--.

Line 52, after "previously" insert --been--.

COLUMN 12

Line 66, "of" should read --to--.

Signed and Sealed this

*Twenty-fourth* Day of *December 1985*

[SEAL]

*Attest:*

DONALD J. QUIGG

*Attesting Officer*

*Commissioner of Patents and Trademarks*